US011773526B2

(12) United States Patent
Xu et al.

(10) Patent No.: US 11,773,526 B2
(45) Date of Patent: Oct. 3, 2023

(54) LAUNDRY TREATING APPARATUS

(71) Applicants: QINGDAO HAIER DRUM WASHING MACHINE CO., LTD., Shandong (CN); Haier Smart Home Co., Ltd., Shandong (CN)

(72) Inventors: Yonghong Xu, Qingdao (CN); Tao Huang, Qingdao (CN); Bencai Huang, Qingdao (CN); Xueli Zhao, Qingdao (CN)

(73) Assignees: QINGDAO HAIER DRUM WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 0 days.

(21) Appl. No.: 17/701,983

(22) Filed: Mar. 23, 2022

(65) Prior Publication Data

US 2022/0213637 A1 Jul. 7, 2022

Related U.S. Application Data

(63) Continuation of application No. 17/416,649, filed as application No. PCT/CN2019/125902 on Dec. 17, 2019.

(30) Foreign Application Priority Data

Dec. 19, 2018 (CN) ..... 201811557254.8
Dec. 19, 2018 (CN) ..... 201811557261.8
(Continued)

(51) Int. Cl.
*D06F 39/00* (2020.01)
*D06F 23/02* (2006.01)
(Continued)

(52) U.S. Cl.
CPC ..... *D06F 39/008* (2013.01); *D06F 23/02* (2013.01); *D06F 37/20* (2013.01); *D06F 39/088* (2013.01)

(58) Field of Classification Search
CPC ..... D06F 37/20; D06F 39/02; D06F 39/008; D06F 39/088
See application file for complete search history.

(56) References Cited

U.S. PATENT DOCUMENTS

2007/0125134 A1* 6/2007 Park ..... D06F 39/02 68/17 R
2014/0299164 A1* 10/2014 Zhang ..... D06F 33/43 134/199
2015/0225887 A1* 8/2015 Schulze ..... D06F 39/008 8/137

FOREIGN PATENT DOCUMENTS

CN 204728096 U 10/2015
CN 205134025 U 4/2016
(Continued)

OTHER PUBLICATIONS

Machine translation of WO-2013178530-A1. (Year: 2013).*
(Continued)

*Primary Examiner* — Joseph L. Perrin
(74) *Attorney, Agent, or Firm* — Maier & Maier, PLLC

(57) ABSTRACT

A clothing treatment apparatus including a housing, a water-containing assembly and a sprinkling assembly that are arranged in the housing. The water-containing assembly has a water tank and a siphon member arranged in the water tank, the siphon member is connected to the sprinkling assembly through a first delivery pipeline, the siphon member is configured to suck out water in the water tank by siphoning, and the sprinkling assembly is configured to perform sprinkling washing on the clothing.

7 Claims, 2 Drawing Sheets

(30) Foreign Application Priority Data

Dec. 19, 2018 (CN) ..... 201811560199.8
Dec. 19, 2018 (CN) ..... 201811560212.X
Dec. 19, 2018 (CN) ..... 201811567338.X

(51) Int. Cl.
*D06F 37/20* (2006.01)
*D06F 39/08* (2006.01)

(56) References Cited

FOREIGN PATENT DOCUMENTS

| | | | | | |
|---|---|---|---|---|---|
| CN | 107503085 | A | | 12/2017 | |
| CN | 207933741 | U | * | 10/2018 | |
| CN | 208009075 | U | | 10/2018 | |
| CN | 209703096 | U | | 11/2019 | |
| CN | 209703097 | U | | 11/2019 | |
| CN | 209703101 | U | | 11/2019 | |
| CN | 209703103 | U | | 11/2019 | |
| JP | 2009247770 | A | | 10/2009 | |
| WO | WO-2013178530 | A1 | * | 12/2013 | ..... D06F 39/028 |

OTHER PUBLICATIONS

Machine translation of CN-207933741-U. (Year: 2018).*
International Search Report dated Mar. 19, 2020 in corresponding International Application No. PCT/CN2019/125902; 8 pages.

* cited by examiner

LAUNDRY TREATING APPARATUS

RELATED APPLICATION

This patent application is a divisional application of U.S. patent application Ser. No. 17/416,649, and claims all benefit of the same.

FIELD OF THE INVENTION

The present disclosure belongs to the technical field of clothing treatment, and specifically provides a clothing treatment apparatus.

BACKGROUND ART

A clothing treatment apparatus is an apparatus capable of washing, drying, sterilizing and/or deodorizing clothing. With the continuous improvement of production level and ongoing growth of users' needs, users have also raised higher and higher requirements on the clothing treatment apparatus.

In the prior art, taking a washing machine as an example, the clothing is generally washed by water. The washing process is accompanied by mechanical rotation, so that stains on the clothing are washed away. However, this washing method has a limitation in that if a large amount of water is injected into a washing drum at the beginning, the stains on a surface of the clothing will directly enter a lining of the clothing in a state where a washing liquid is not completely dissolved, so that more time, water amount, washing liquid and mechanical action are required for washing the clothing clean in the subsequent washing process, thus resulting in a poor washing effect. Therefore, the clothing can be washed by atomized air washing. An atomization generator is required to be provided for this kind of washing machine, and the atomization generator needs a driving board for driving. If the driving board and a control panel of the washing machine are installed together, more space of a washing machine tray will be inevitably occupied, and a relatively long wire harness is required to connect the driving board with the atomization generator, which makes it inconvenient to arrange the wire harness; therefore, the kind of washing machine with the atomization generator has significant limitations in actual production.

With the advancement of science and technology, the automation level of human life is becoming higher and higher, and for daily housework, manpower is being gradually replaced by machines. As a common household appliance in daily life, the clothing treatment apparatus has brought great convenience to people's lives. According to the washing mode, the clothing treatment apparatus can be roughly divided into a pulsator washing machine and a drum washing machine. Taking the drum washing machine as an example, the clothing is generally washed by water. The washing process is accompanied by mechanical rotation, so that stains on the clothing are washed away. However, this washing method has a limitation in that if a large amount of water is injected into the washing drum at the beginning, the stains on the surface of the clothing will directly enter the lining of the clothing in a state where the washing liquid is not completely dissolved, so that more time, water amount, washing liquid and mechanical action are required for washing the clothing clean in the subsequent washing process, thus resulting in a poor washing effect.

In order to solve the above problems, the drum washing machine is equipped with an atomization generator and a water tank for supplying water to the atomization generator. Under the atomization action of the atomization generator, the water is converted into small particles of atomized water droplets to realize a treatment of the clothing by atomized air, which improves the washing effect of the clothing and improves the user experience in use. However, the water tank of the above-mentioned drum washing machine cannot divert and block the water injected into it, and it is difficult to meet the user's use demand of supplying water to different apparatuses successively, which greatly affects the user experience in use.

With the advancement of science and technology, the automation level of human life is becoming higher and higher, and for daily housework, manpower is being gradually replaced by machines. As a common household appliance in daily life, the clothing treatment apparatus has brought great convenience to people's lives. According to the washing mode, the clothing treatment apparatus can be roughly divided into a pulsator washing machine and a drum washing machine. Taking the drum washing machine as an example, the clothing is generally washed by water. The washing process is accompanied by mechanical rotation, so that stains on the clothing are washed away. However, this washing method has a limitation in that if a large amount of water is injected into the washing drum at the beginning, the stains on the surface of the clothing will directly enter the lining of the clothing in a state where the washing liquid is not completely dissolved, so that more time, water amount, washing liquid and mechanical action are required for washing the clothing clean in the subsequent washing process, thus resulting in a poor washing effect.

In order to solve the above problems, the drum washing machine is equipped with an atomization generator and a water tank for supplying water to the atomization generator. Under the atomization action of the atomization generator, the water is converted into small particles of atomized water droplets to realize a treatment of the clothing by atomized air, which improves the washing effect of the clothing and improves the user experience in use. However, the function of the water tank of the above-mentioned drum washing machine is single, which can only meet the demand of supplying water to the atomization generator, and cannot meet the user's other use demands, which greatly affects the user's experience in use.

With the advancement of science and technology, the automation level of human life is becoming higher and higher, and for daily housework, manpower is being gradually replaced by machines. As a common household appliance in daily life, the clothing treatment apparatus has brought great convenience to people's lives. According to the washing mode, the clothing treatment apparatus can be roughly divided into a pulsator washing machine and a drum washing machine. Taking the drum washing machine as an example, the clothing is generally washed by water. The washing process is accompanied by mechanical rotation, so that stains on the clothing are washed away. However, this washing method has a limitation in that if a large amount of water is injected into the washing drum at the beginning, the stains on the surface of the clothing will directly enter the lining of the clothing in a state where the washing liquid is not completely dissolved, so that more time, water amount, washing liquid and mechanical action are required for washing the clothing clean in the subsequent washing process, thus resulting in a poor washing effect.

In order to solve the above problems, the drum washing machine is equipped with an atomization generator and a water tank for supplying water to the atomization generator.

Under the atomization action of the atomization generator, the water is converted into small particles of atomized water droplets to realize a treatment of the clothing by atomized air, which improves the washing effect of the clothing and improves the user experience in use. However, after the atomization is completed in the water tank of the above-mentioned drum washing machine, a small amount of water will remain in the water tank. If this part of water is not discharged, bacteria will grow in the water tank, which will affect the hygienic security of the drum washing machine and greatly affect the user's experience in use.

A clothing treatment apparatus is an apparatus capable of washing, drying, sterilizing and/or deodorizing clothing. With the continuous improvement of production level and ongoing growth of users' needs, users have also raised higher and higher requirements on the clothing treatment apparatus.

In the prior art, taking the washing machine as an example, the clothing is generally washed by water. The washing process is accompanied by mechanical rotation, so that stains on the clothing are washed away. However, this washing method has a limitation in that if a large amount of water is injected into the washing drum at the beginning, the stains on the surface of the clothing will directly enter the lining of the clothing in a state where the washing liquid is not completely dissolved, so that more time, water amount, washing liquid and mechanical action are required for washing the clothing clean in the subsequent washing process, thus resulting in a poor washing effect. In existing clothing treatment apparatuses, other functions are often added on the basis of the washing machine, such as adding a drying function to become a washing-drying integrated machine, etc. Such an improvement does not significantly improve the washing effect of the washing machine. Moreover, current washing machines still cannot achieve in-depth treatment of clothing made of special materials, such as cashmere, wool and other materials. If the traditional washing by water is used, it is highly possible that fiber structures of the clothing will be damaged, which will cause a very big limitation on an applicable range of the clothing of the washing machine.

Accordingly, there is a need for a new clothing treatment apparatus in the art to solve the above problems.

BRIEF SUMMARY OF THE INVENTION

In order to solve the above problem in the prior art, that is, in order to solve the problem that the residual water in the water-containing assembly of the existing clothing treatment apparatus cannot be discharged, the present disclosure provides a clothing treatment apparatus, and the clothing treatment apparatus includes a housing, and a water-containing assembly and a sprinkling assembly that are arranged in the housing; the water-containing assembly includes a water tank and a siphon member arranged in the water tank, the siphon member is connected to the sprinkling assembly through a first delivery pipeline, the siphon member is configured to suck out water in the water tank by siphoning, and the sprinkling assembly is configured to perform sprinkling washing on the clothing.

In a preferred technical solution of the above clothing treatment apparatus, the water tank includes a cabinet and a cover arranged above the cabinet; the siphon member includes a siphon cap arranged on the cover and a siphon tube arranged in the cabinet, and the siphon tube communicates with the first delivery pipeline through a first outlet of the cabinet; when the cover is closed with the cabinet, the siphon cap can be sleeved over the siphon tube, a siphon channel is formed between the siphon cap and the siphon tube, and the water in the cabinet can flow to the sprinkling assembly through the siphon channel and the first delivery pipeline.

In a preferred technical solution of the above clothing treatment apparatus, the clothing treatment apparatus further includes an outer cylinder arranged in the housing and an inner cylinder rotatably accommodated in the outer cylinder, the housing is provided with a clothing inlet, and a window gasket is arranged between the clothing inlet and the outer cylinder; the sprinkling assembly includes a first sprinkling head arranged on the window gasket, a second outlet of the cabinet is connected to the first sprinkling head through a second delivery pipeline, and the first sprinkling head is configured to spray water into the inner cylinder.

In a preferred technical solution of the above clothing treatment apparatus, the clothing treatment apparatus further includes a door pivotally connected to the housing, and the door is provided with a viewing window; the sprinkling assembly further includes a second sprinkling head arranged on the window gasket, the first outlet of the cabinet is connected to the second sprinkling head through the first delivery pipeline, and the second sprinkling head is configured to spray water onto the viewing window.

In a preferred technical solution of the above clothing treatment apparatus, a height of the second outlet of the cabinet is larger than a height of the first outlet of the cabinet.

In a preferred technical solution of the above clothing treatment apparatus, the clothing treatment apparatus further includes an atomization generator arranged on the window gasket; a third outlet of the cabinet is connected to the atomization generator through a third delivery pipeline, and the atomization generator is configured to perform atomized washing on the clothing.

In a preferred technical solution of the above clothing treatment apparatus, the clothing treatment apparatus further includes a water supply valve, a water delivery channel and a one-way check structure that are arranged in the housing; the water supply valve is connected to a water inlet end of the water delivery channel, a water outlet end of the water delivery channel is connected to the atomization generator through the water tank, the one-way check structure is connected to the water delivery channel and the water tank respectively, and the one-way check structure is arranged to be isolated from the atmosphere when the water supply valve is opened and to communicate with the atmosphere when the water supply valve is closed.

In a preferred technical solution of the above clothing treatment apparatus, the one-way check structure is a one-way check valve.

In a preferred technical solution of the above clothing treatment apparatus, the water tank further includes a positioning member, and the cover is placed onto a top of the cabinet through the positioning member.

In a preferred technical solution of the above clothing treatment apparatus, the positioning member includes a positioning post or a positioning hole provided in the cabinet and a positioning hole or a positioning post provided on the cover, and the positioning post or the positioning hole in the cabinet can match with the positioning hole or the positioning post on the cover.

Those skilled in the art can understand that in the preferred technical solutions of the present disclosure, the drum washing machine includes a housing, and a water-containing assembly and a sprinkling assembly arranged in the housing.

As compared with the existing technical solution in which the residual water in the water tank cannot be discharged, the water-containing assembly of the present disclosure includes a water tank and a siphon member arranged in the water tank, the siphon member is connected to the sprinkling assembly through a first delivery pipeline, and the sprinkling assembly is configured to perform sprinkling washing on the clothing. When the water tank is completely filled with water or a siphon liquid level is reached, the siphon member can suck out all the water in the water tank by siphoning, so that all the water in the water tank is emptied, which prevents water from remaining in the water tank, thereby preventing the water tank from becoming moldy, deteriorating, and breeding bacteria, and improving the hygienic security of the drum washing machine.

Further, the first outlet of the cabinet is connected to the second sprinkling head through the first delivery pipeline, the second outlet of the cabinet is connected to the first sprinkling head through the second delivery pipeline, and the third outlet of the cabinet is connected to the atomization generator through the third delivery pipeline, so that the water tank can not only supply water to the atomization generator, but also can supply water to the sprinkling assembly. Therefore, the drum washing machine has two clothing washing modes, i.e., atomized air washing and sprinkling washing, so that users can flexibly select the corresponding washing mode according to their own needs to meet various requirements of users and improve the user experience.

Further, the drum washing machine includes a water supply valve, a water delivery channel and a one-way check structure that are arranged in the housing. By connecting the one-way check structure with the water delivery channel and the water tank, when the water supply valve is opened, water can be injected into the water delivery channel and the water tank, and then when the water supply valve is closed, the one-way check structure communicates with the atmosphere so that the water in the water delivery channel and the water tank is sprayed from the atomization generator. The water is converted into small particles of atomized water droplets under the atomization action of the atomization generator, thereby realizing a tender treatment of the clothing by atomized air. The use of this atomized air washing method can treat clothing of special materials such as cashmere, wool, etc., which not only can make the surface of the clothing of this material smoother and softer, but also can quickly remove stains on the clothing without damaging the fiber structures of the clothing, thereby increasing the applicable range of the clothing of the drum washing machine and further improving the user experience.

BRIEF DESCRIPTION OF THE DRAWINGS

Hereinafter, the clothing treatment apparatus of the present disclosure will be described with reference to the accompanying drawings and in conjunction with a drum washing machine. In the drawings.

DETAILED DESCRIPTION OF THE INVENTION

Fourth Technical Solution

The preferred embodiments of the present disclosure will be described below with reference to the drawings. Those skilled in the art should understand that these embodiments are only used to explain the technical principles of the present disclosure, and are not intended to limit the scope of protection of the present disclosure. For example, although the present application is described in conjunction with a drum washing machine, the technical solution of the present disclosure is not limited to this. The water-containing assembly can obviously also be applied to other clothing treatment apparatuses such as a pulsator washing machine, a shoe washing machine, a washing-drying integrated machine, etc., and such changes do not deviate from the principle and scope of the present disclosure.

It should be noted that in the description of the present disclosure, terms indicating directional or positional relationships, such as "inside", "bottom" and the like, are based on the directional or positional relationships shown in the accompanying drawings. They are only used for ease of description, and do not indicate or imply that the device or element must have a specific orientation, or be constructed or operated in a specific orientation, and therefore they should not be considered as limitations to the present disclosure. In addition, the terms "first", "second" and "third" are only used for descriptive purposes, and cannot be understood as indicating or implying relative importance.

In addition, it should also be noted that in the description of the present disclosure, unless otherwise clearly specified and defined, terms "install", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

Based on the problem in the prior art pointed out in the "BACKGROUND OF THE INVENTION", the siphon member of the present disclosure is connected to the sprinkling assembly through the first delivery pipeline. When the water tank is completely filled with water or a siphon liquid level is reached, the siphon member can suck out all the water in the water tank by siphoning, so that all the water in the water tank is emptied, which prevents water from remaining in the water tank, thereby preventing the water tank from becoming moldy, deteriorating, and breeding bacteria, and improving the hygienic security of the drum washing machine.

Figure 1:
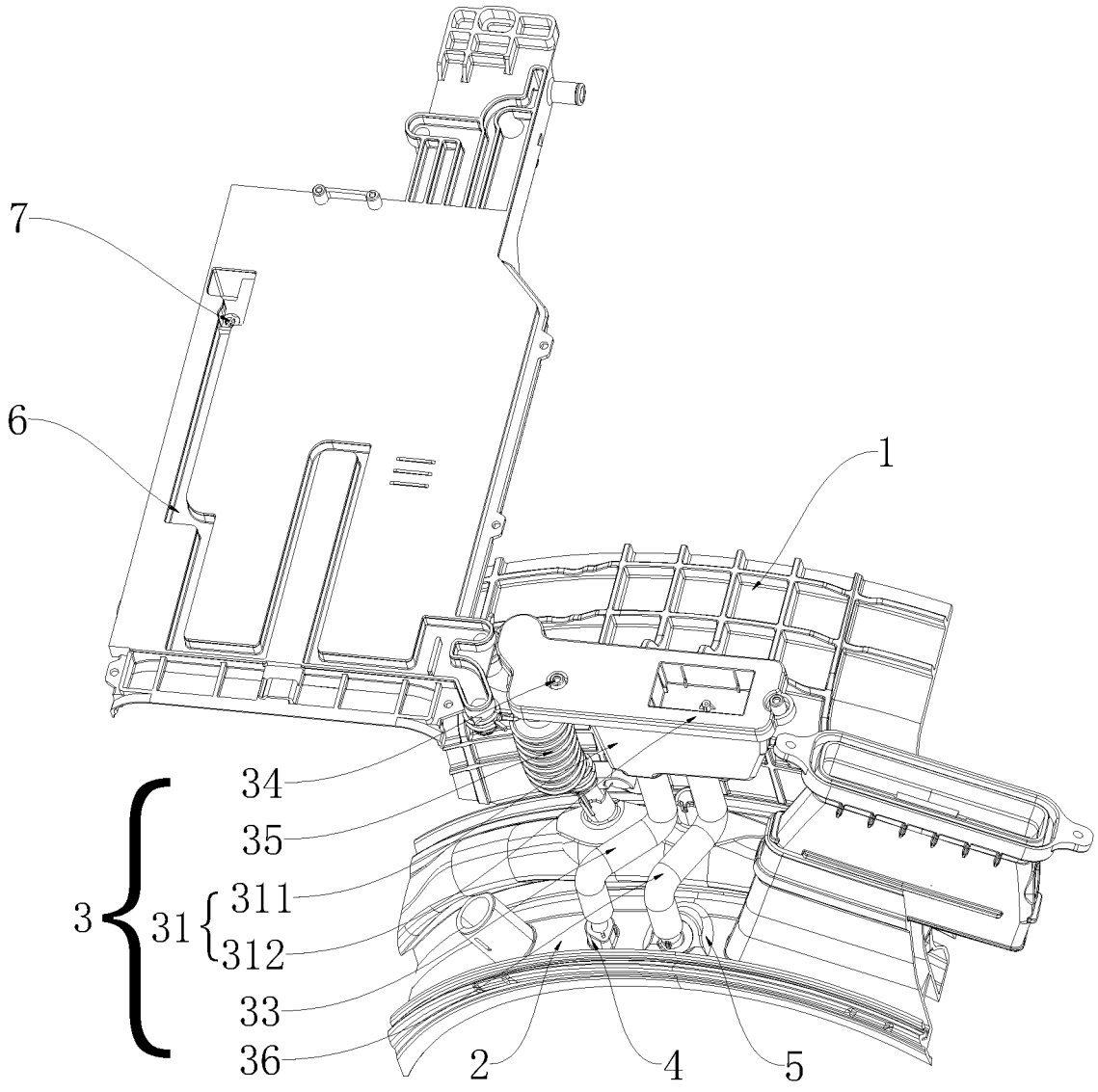
FIG. 1 is a schematic view of a partial structure of a drum washing machine according to the fourth technical solution of the present disclosure.
Figure 2:
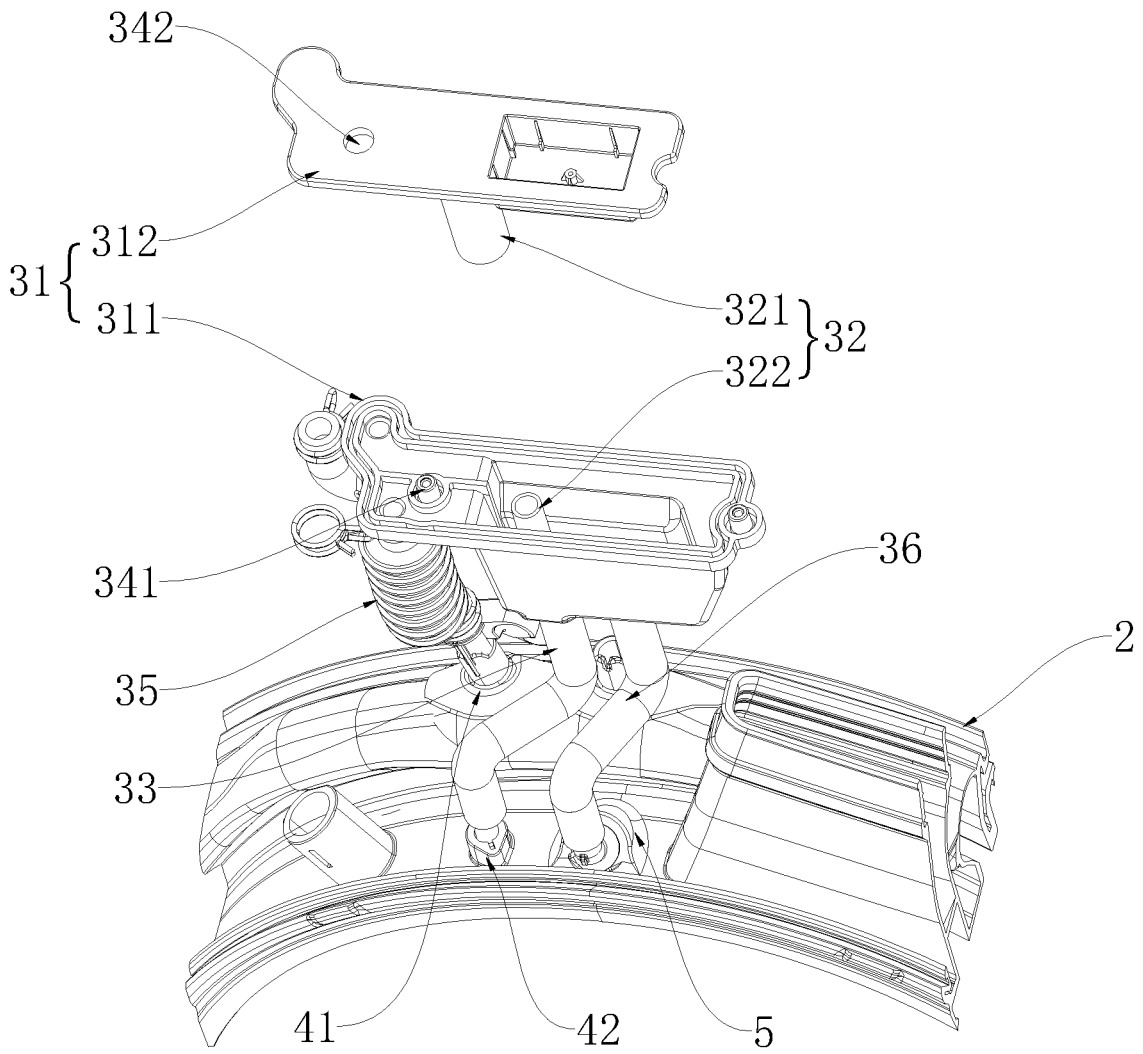
FIG. 2 is an exploded view of a water-containing assembly according to the fourth technical solution of the present disclosure.

Referring to FIGS. 1 and 2, FIG. 1 is a schematic view of a partial structure of the drum washing machine of the present disclosure, and FIG. 2 is an exploded view of the water-containing assembly of the present disclosure. The drum washing machine of the present disclosure includes a housing and a door, the door is pivotally connected with the housing, and a viewing window is provided on the door to facilitate the user to observe a washing condition of the clothing in an inner cylinder. As shown in FIG. 1, the drum washing machine also includes an outer cylinder 1, an inner cylinder, a window gasket 2, a water-containing assembly 3, a sprinkling assembly 4, and an atomization generator 5. The outer cylinder 1 is arranged in the housing, the inner cylinder is rotatably accommodated in the outer cylinder 1, the housing is provided with a clothing inlet, and the window gasket 2 is arranged between the clothing inlet and the outer cylinder 1; the water-containing assembly 3 is arranged in the housing, and the water-containing assembly 3 is configured to supply water to the sprinkling assembly 4 and the atomization generator 5; the sprinkling assembly 4 and the atomization generator 5 are arranged on the window gasket 2. The sprinkling assembly 4 is configured to perform sprinkling washing on the clothing, and the atomization generator 5 is configured to perform atomized washing on the clothing. Of course, the positions where the water-containing assembly 3, the sprinkling assembly 4, and the atomization generator 5 are actually installed are not limited to the above-exemplified installation positions. Those skilled in the art may flexibly set the positions where the water-containing assembly 3, the sprinkling assembly 4, and the atomization generator 5 are actually installed in practical applications, as long as the water-containing assembly 3, the sprinkling assembly 4 and the atomization generator 5 cooperate to enable the drum washing machine to have two clothing washing modes: atomized air washing and sprinkling washing.

Preferably, the atomization generator 5 may be an ultrasonic atomization generator 5 or a compressed atomization generator 5. Those skilled in the art may flexibly set the specific structure of the atomization generator 5 in practical applications, as long as the atomization generator 5 can convert the water in the water-containing assembly 3 into atomized water droplets so as to perform atomized air washing of the clothing.

In a preferred embodiment, as shown in FIG. 2, the water-containing assembly 3 includes a water tank 31 and a siphon member 32. The siphon member 32 is arranged in the water tank 31, the siphon member 32 is connected to the sprinkling assembly 4 through a first delivery pipeline 33, and the siphon member 32 is configured to suck out the water in the water tank 31 by siphoning, which prevents water from remaining in the water tank 31, thereby preventing the water tank 31 from becoming moldy, deteriorating, and breeding bacteria, and improving the hygienic security of the drum washing machine.

Preferably, as shown in FIG. 2, the water tank 31 includes a cabinet 311 and a cover 312, and the cover 312 can be covered on the cabinet 311, so that the interior of the cabinet 311 forms a relatively closed environment to facilitate the water in the water tank 31 to be sprayed from the atomization generator.

In order to improve the stability of the connection between the cabinet 311 and the cover 312, as shown in FIG. 2, the water tank 31 further includes a positioning member 34. The cover 312 is placed on the top of the cabinet 311 through the positioning member 34, thereby avoiding a lateral displacement of the cover 312 relative to the cabinet 311, enabling the cover 312 to be firmly fixed on the cabinet 311, and preventing the cover 312 from falling off the cabinet 311.

Preferably, the positioning member 34 includes a positioning post 341 provided in the cabinet 311 and a positioning hole 342 provided on the cover 312. The positioning post 341 in the cabinet 311 can match with the positioning hole 342 on the cover 312, so as to realize the positioning between the cabinet 311 and the cover 312. Of course, the actual installation positions of the positioning post 341 and the positioning hole 342 are not limited to the positions listed above. The positioning post 341 may also be provided on the cover 312, and the positioning hole 342 may be provided in the cabinet 311, as long as the positioning post 341 can match with the positioning hole 342 to place the cover 312 on the top of the cabinet 311.

Of course, the structure of the positioning member 34 is also not limited to the above-exemplified structure. The structure of a positioning block and a positioning groove or the structure of a positioning claw may also be used. Any positioning structure can be adopted, as long as the cover 312 can be placed on the top of the cabinet 311.

Preferably, as shown in FIG. 2, the sprinkling assembly 4 includes a first sprinkling head 41 and a second sprinkling head 42, and both the first sprinkling head 41 and the second sprinkling head 42 are arranged on the window gasket. A second outlet of the cabinet 311 is connected to the first sprinkling head 41 through a second delivery pipeline 35, and the first sprinkling head 41 is configured to spray water into the inner cylinder so as to perform sprinkling washing on the clothing. A first outlet of the cabinet 311 is connected to the second sprinkling head 42 through the first delivery pipeline 33. The second sprinkling head 42 is configured to spray water on the viewing window to wash away the washing water splashed onto the viewing window, so that the user can clearly observe a washing condition of the clothing in the inner cylinder.

Preferably, a height of the second outlet of the cabinet 311 is larger than a height of the first outlet of the cabinet 311, so that the water in the cabinet 311 is preferably discharged through the first outlet, that is, the water in the cabinet 311 is sprayed onto the viewing window preferably through the second sprinkling head 42.

Preferably, as shown in FIG. 2, the siphon member 32 includes a siphon cap 321 and a siphon tube 322, the siphon cap 321 is arranged on the cover 312, the siphon tube 322 is arranged in the cabinet 311, and the siphon tube 322 communicates with the first delivery pipeline 33 through the first outlet of the cabinet 311. When the cover 312 is closed with the cabinet 311, the siphon cap 321 can be sleeved over the siphon tube 322. A siphon channel is formed between the siphon cap 321 and the siphon tube 322. When the cabinet 311 is completely filled with water or a siphon liquid level is reached, the water in the cabinet 311 can be sucked out through the siphon channel, and the sucked-out water flows to the second sprinkling head 42 through the first delivery pipeline 33, and is sprayed onto the viewing window through the second sprinkling head 42.

Preferably, a height of the siphon cap 321 is slightly smaller than a height of the cabinet 311, so that there is a gap between a bottom of the siphon cap 321 and a bottom of the cabinet 311, thus enabling the water in the cabinet 311 to be siphoned into the siphon channel through the gap.

Preferably, a height of the siphon tube 322 is slightly smaller than the height of the cabinet 311, and when the siphon cap 321 can be sleeved over the siphon tube 322, there is a gap between a top of the siphon tube 322 and a top of the siphon cap 321, so that the water siphoned into the siphon channel can flow into the siphon tube 322 through the gap, flow into the first delivery pipeline 33 through the first outlet of the cabinet 311, and be delivered to the sprinkling assembly 4 through the first delivery pipeline 33.

Of course, the structure of the siphon member 32 is not limited to the above-exemplified structure. Those skilled in the art may flexibly set the structure of the siphon member 32 in practical applications, as long as the siphon member 32 can suck out all the water in the water tank 31 by siphoning.

In order to make the atomization generator 5 smoothly generate atomized water droplets, as shown in FIG. 1 and with reference to FIG. 2, the drum washing machine further includes a water supply valve (not shown in the figure), a water delivery channel 6 and a one-way check structure 7 that are arranged in the housing; the water supply valve is connected to a water inlet end of the water delivery channel 6, a water outlet end of the water delivery channel 6 is connected to the inlet of the cabinet 311, a third outlet of the cabinet 311 is connected with the atomization generator 5 through a third delivery pipeline 36, the one-way check structure 7 is connected with the water delivery channel 6 and the water tank 31 respectively, and the one-way check structure 7 is arranged to be isolated from the atmosphere when the water supply valve is opened and to communicate with the atmosphere when the water supply valve is closed. Specifically, when the water supply valve is always open, it is very difficult for the atomization generator 5 to form atomized water droplets under the action of water pressure. Therefore, the water supply valve can be opened to accumulate water in the water delivery channel 6 and the water tank 31; then the water supply valve is closed. At this time, the water in the water delivery channel 6 and the water tank 31 can be sprayed onto the clothing in the form of atomized water droplets from the atomization generator 5 according to the principle of atmospheric communication, so as to ensure that the atomization generator 5 can perform atomized air washing of the clothing. If it is required to inject a large amount of water into the inner cylinder, the atomization generator 5 is closed at this time so as to keep the water supply valve always open and ensure that the second delivery pipeline 35 is in a communicated state, thereby achieving continuous water injection into the inner cylinder.

Preferably, the one-way check structure 7 is a one-way check valve. Of course, the one-way check structure 7 is not limited to the above-exemplified structures, and other combined structures of a one-way check valve and pipelines can also be used. For example, the one-way check valve is connected to the water delivery channel 6 through a first connection pipeline, and the one-way check valve is connected to the inlet of the water tank 31 through a second connection pipeline. Alternatively, a combined structure of a plug and pipelines may be used. Any structure can be adopted, as long as the one-way check structure 7 can be isolated from the atmosphere when the water supply valve is opened and can communicate with the atmosphere when the water supply valve is closed.

Preferably, the position where the one-way check valve is arranged is at a different height from the position where the outlet of the atomization generator 5 is arranged, so that when the one-way check valve communicates with the atmosphere, a certain liquid level difference is formed between the one-way check valve and the outlet of the atomization generator 5. Therefore, the water accumulated in water delivery channel 6 and the water tank 31 can be more easily sprayed onto the clothing in the form of atomized water droplets from the atomization generator 5.

Further, since the position where the water delivery channel 6 is arranged is generally higher than the position where the outer cylinder 1 is arranged in the drum washing machine, the position where the one-way check valve is arranged is set to be higher than the position where the outlet of the atomization generator 5 is arranged, thereby making full use of the original structure of the drum washing machine.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A clothing treatment apparatus, comprising:

a housing; and a water-containing assembly arranged in the housing; and a sprinkling assembly arranged in the housing;

wherein the clothing treatment apparatus comprises an outer cylinder arranged in the housing and an inner cylinder rotatably accommodated in the outer cylinder, wherein the housing is provided with a clothing inlet, and a window gasket is arranged between the clothing inlet and the outer cylinder, and wherein the sprinkling assembly is arranged on the window gasket;

wherein the water-containing assembly comprises a water tank and a siphon member arranged in the water tank, the siphon member is connected to the sprinkling assembly through a first delivery pipeline, the siphon member is configured to suck out water in the water tank by siphoning, and the sprinkling assembly is configured to perform sprinkling washing on the clothing within the inner cylinder;

wherein the water tank comprises a cabinet and a cover arranged above the cabinet; and wherein the siphon member comprises a siphon cap arranged on the cover and a siphon tube arranged in the cabinet, and the siphon tube communicates with the first delivery pipeline through a first outlet of the cabinet; when the cover is closed with the cabinet, the siphon cap is configured to be sleeved over the siphon tube, a siphon channel is formed between the siphon cap and the siphon tube, and the water in the cabinet can flow to the sprinkling assembly through the siphon channel and the first delivery pipeline; and wherein the water tank further comprises a positioning member, and the cover is placed onto a top of the cabinet through the positioning member; and wherein the positioning member comprises a positioning post or a positioning hole provided in the cabinet and a positioning hole or a positioning post provided on the cover, and the positioning post or the positioning hole in the cabinet is configured to match with the positioning hole or the positioning post on the cover.

2. The clothing treatment apparatus according to claim 1, wherein the sprinkling assembly comprises a first sprinkling head arranged on the window gasket, a second outlet of the cabinet is connected to the first sprinkling head through a second delivery pipeline, and the first sprinkling head is configured to spray water into the inner cylinder.

3. The clothing treatment apparatus according to claim 2, further comprising a door pivotally connected to the housing, the door being provided with a viewing window;

wherein the sprinkling assembly further comprises a second sprinkling head arranged on the window gasket, the first outlet of the cabinet is connected to the second sprinkling head through the first delivery pipeline, and the second sprinkling head is configured to spray water onto the viewing window.

4. The clothing treatment apparatus according to claim 3, wherein a height of the second outlet of the cabinet is larger than a height of the first outlet of the cabinet.

5. The clothing treatment apparatus according to any one of claims 2 to 4, further comprising an atomization generator arranged on the window gasket;

wherein a third outlet of the cabinet is connected to the atomization generator through a third delivery pipeline, and the atomization generator is configured to perform atomized washing on the clothing.

6. The clothing treatment apparatus according to claim 1, further comprising:

a water supply valve arranged in the housing;

a water delivery channel arranged in the housing; and a one-way check structure arranged in the housing;

wherein the water supply valve is connected to a water inlet end of the water delivery channel, a water outlet end of the water delivery channel is connected to the atomization generator through the water tank, the one-way check structure is connected to the water delivery channel and the water tank respectively, and the one-way check structure is arranged to be isolated from the atmosphere when the water supply valve is opened and to communicate with the atmosphere when the water supply valve is closed.

7. The clothing treatment apparatus according to claim 6, wherein the one-way check structure is a one-way check valve.

* * * * *